US008307953B2

(12) United States Patent
Ferreira

(10) Patent No.: US 8,307,953 B2
(45) Date of Patent: Nov. 13, 2012

(54) ELEVATOR CAR POSITION DETECTION SYSTEM AND METHOD OF DETERMINING A POSITION OF AN ELEVATOR CAR IN AN ELEVATOR SHAFT

(75) Inventor: Teofilo Ferreira, Locarno (CH)

(73) Assignee: Inventio AG, Hergiswil NW (CH)

( * ) Notice: Subject to any disclaimer, the term of this patent is extended or adjusted under 35 U.S.C. 154(b) by 344 days.

(21) Appl. No.: 12/745,074

(22) PCT Filed: Nov. 7, 2008

(86) PCT No.: PCT/EP2008/065163

§ 371 (c)(1),
(2), (4) Date: May 27, 2010

(87) PCT Pub. No.: WO2009/071417

PCT Pub. Date: Jun. 11, 2009

(65) Prior Publication Data

US 2010/0320036 A1 Dec. 23, 2010

(30) Foreign Application Priority Data

Dec. 7, 2007 (EP) ..... 07122686

(51) Int. Cl.
*B66B 1/34* (2006.01)

(52) U.S. Cl. ..... 187/394; 187/247

(58) Field of Classification Search ..... 187/247, 187/248, 391–394, 397–399; 340/547, 551
See application file for complete search history.

(56) References Cited

U.S. PATENT DOCUMENTS

| | | | | |
|---|---|---|---|---|
| 4,083,430 | A | 4/1978 | Gingrich | |
| 4,427,095 | A * | 1/1984 | Payne et al. | 187/394 |
| 5,594,219 | A * | 1/1997 | Kamani et al. | 187/394 |
| 6,128,116 | A * | 10/2000 | Dobler et al. | 398/106 |
| 6,435,315 | B1 | 8/2002 | Zaharia | |
| 6,986,409 | B2 * | 1/2006 | Birbaumer | 187/394 |
| 7,588,127 | B2 * | 9/2009 | Shiratsuki et al. | 187/391 |
| 7,849,975 | B2 * | 12/2010 | Ketonen et al. | 187/394 |
| 7,891,467 | B2 * | 2/2011 | Kattainen et al. | 187/394 |
| 2004/0195048 | A1 | 10/2004 | Schonauer et al. | |

FOREIGN PATENT DOCUMENTS

WO 03066496 A1 8/2003

* cited by examiner

*Primary Examiner* — Anthony Salata
(74) *Attorney, Agent, or Firm* — Fraser Clemens Martin & Miller LLC; William J. Clemens

(57) ABSTRACT

Elevator cabin position detection system comprising an activation device mounted on an elevator car, a sensor stripe mounted on a sidewall of an elevator shaft and control electronics. The activation device, preferably a light emitting device, activates a portion of the sensor stripe which comprises a feed line, a resistor line and sensors positioned between these. The sensors, preferably optical sensors, when activated by the activation device, conduct electricity to create electrical connection between the feed line and resistor line and thus modify the resulting resistance between an end (A) of the resistor line and an end (B) of the feed line. The control electronics determines the exact position of the elevator cabin based on the resulting resistance between the end (A) of the resistor line and the end (B) of the feed line.

20 Claims, 5 Drawing Sheets

ELEVATOR CAR POSITION DETECTION SYSTEM AND METHOD OF DETERMINING A POSITION OF AN ELEVATOR CAR IN AN ELEVATOR SHAFT

FIELD OF THE INVENTION

The present invention relates to elevator car position detection systems, which are capable to precisely indicate the exact vertical position of an elevator within the elevator shaft and a corresponding method of determining a position of an elevator car in an elevator shaft.

BACKGROUND OF THE INVENTION

It is a known problem that, since the suspension cables of elevators can change their length in time or due to temperature changes and because the winch that winds these cables has some errors due to slips or other unpredictable events, the exact position of an elevator car can not be determined solely by the positioning of the suspension system. This means that even if a direct relation exists between the number of rotations of the winch and the height of the car, several factors can affect this relation. For this reason, a dedicated positioning system is required to be able to precisely determine the actual position of the elevator car within the shaft. Such systems must be independent from the suspension system in that the detection should not rely on the length of the cable wound up or on the rotational position of the winch because this might lead to serious errors ranging from a few centimeters up to meters if very long suspension cables are used.

Several approaches are known in the art to determine the exact position of an elevator car. One of these approaches suggests the use of a laser or other strong light source mounted on the car and a detector mounted at one of the shaft's ends and to measure the time needed for the light beam to travel from the emitter to the detector. Based on this measured time and knowing the propagation speed of the signal, light in most cases, one can determine the distance between the two, thus the position of the elevator car. The same principle works the same way if a light source is mounted at an end of the elevator shaft and a mirror is placed on the elevator cabin car to reflect the light back to the sensor. However, in both cases several disadvantages and difficulties arise: it is often a problem to guarantee a clear line of sight between the detector and the light source since the space between the ends of the elevator shaft and the elevator is usually occupied by the suspension cables, communication or power cables and other elements of the elevator system. A further problem is that in very tall shafts (high rise elevators) even a small vibration of the car may cause significant deviation of the light beam rendering the detection of the beam and thus of the car's position unreliable. Ensuring the cleanliness of the light source, the detector and in some cases the reflective mirror might also become a problem in certain cases.

Some elevator positioning systems use marked belts, or tapes that run parallel to the path of the car and a fixed scanner counts the number of markings that pass it as the car moves. However, such systems can only detect relative movement of the car and not absolute position and by that an error in the scanning can pass undetected for an extended period of time.

A different approach is described in U.S. Pat. No. 6,435,315. In this approach a code rail is mounted on a sidewall of the elevator shaft adjacent to the path of travel of the car that contains optically readable indicia and a camera, mounted upon the car, scanning the code rail indicia to determine the location of the car within the shaft. However, even if this system may work well in most cases, it is rather complicated in construction. The concept of this system requires that the detection camera to be mounted on the car itself which means that there is a need of some sort of communication between the position detection system in the car and the control system of the elevator motors in the shaft. This communication can be done by a wired communication line or by radio communication. Both of these have significant drawbacks. On one hand having additional cables between the shaft and car can be problematic because of the presence of the suspension ropes and other moving elements. In open or glass covered shafts it is esthetically undesirable to have additional cables hanging. On the other hand, radio communication between the car and the control system of the elevator motors in the shaft requires additional components and electric energy. Interferences with other radio devices or even intentional jamming of the signal can render the system unreliable.

SUMMARY OF THE INVENTION

An object of the present invention is thus to provide an elevator car position detection system which is reliable in all conditions, which does not require additional communication lines between the car and shaft, which is not sensitive to vibrations of the car and, in the same time, is able to indicate precisely the absolute position of an elevator car. It is a further object of the present invention to provide a solution that is as simple and cost effective as possible, that is suitable for a large variety of applications and that is easy to maintain, preferably requiring no maintenance during operation in normal circumstances.

The above identified objects are achieved by the present invention by employing a sensor stripe on a wall of the elevator shaft directly connected to control electronics and an activation device, preferably a light emitting device, mounted on the elevator car. The activation device is positioned so, that it acts on, respectively illuminates, a portion of said sensor stripe, which comprises a feed line and a resistor line with sensors, preferably optical sensors, positioned between them. As the elevator moves, the activation device activates the different sensors which, when activated, conduct electricity to create a local electrical connection between the feed line and resistor line, thus modifying the resulting resistance between the ends of the feed line and the resistor line. The exact position of the elevator car is determined by the control electronics based on the said resulting resistance.

The solution provided by the present invention offers several advantages, the most important of them being the great simplicity of the system, i.e. the sensor stripe contains simple and reliable components like resistors and in a preferred embodiment photodiodes as optical sensors.

At the same time there are no mechanically moving elements in the system, which increases reliability and lowers maintenance needs of the system. It is also very important to note, that there is no need for a communication line between the car and the control electronics in the shaft.

A further advantage of the system is that the absolute position of the car is directly obtainable from the resulting resistance between the resistor line and the feed line. This means that there is no need for a memory or register in the system to constantly keep the current position of the car, which means that the position of the car can be determined even after a power failure. This is a clear advantage over systems that can detect only relative movement of the car, and once the absolute position of the car is lost due to unforeseen events, the relative movement can not be translated into an absolute position without intervention.

DESCRIPTION OF THE DRAWINGS

Further characteristics and advantages of the invention will in the following be described in detail by means of the description and by making reference to the drawings, which show.

DESCRIPTION OF THE PREFERRED EMBODIMENTS

Figure 1A:
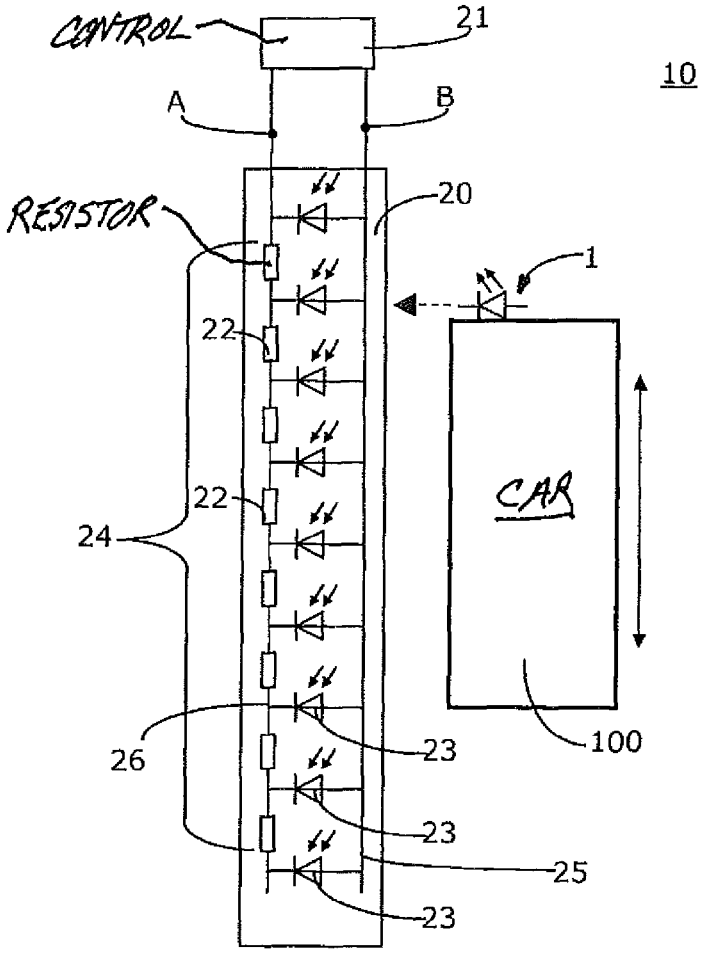
FIG. 1A is a schematic overview of the preferred embodiment of the elevator car position detection system according to the present invention.
Figure 1B:
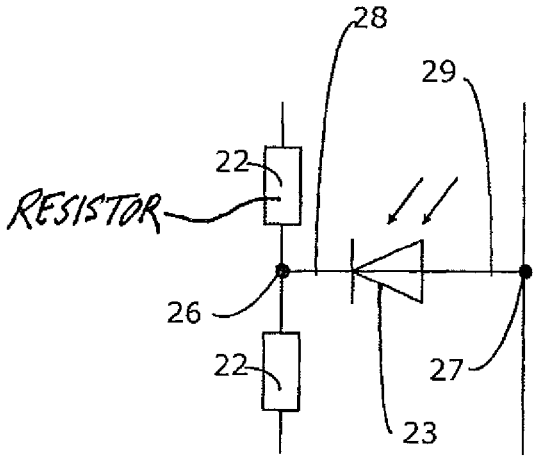
FIG. 1B is a schematic view showing a cell of the sensor strip of the elevator car position detection system according to the present invention.

FIG. 1A shows the preferred embodiment of the elevator car position detection system 10. The idea behind the invention is the use of a sensor stripe 20 in combination with a light emitting device 1 mounted on top of an elevator car 100 and control electronics 21. The sensor stripe 20 comprises a vertical feed line 25 and a vertical resistor line 24 with optical sensors 23 positioned between them. As it is shown in FIG. 1B, the optical sensors 23 are positioned between a node 26 of the resistor line 24 and a node 27 of the feed line 25. In the preferred embodiment the optical sensor 23 is a photodiode or phototransistor which, when illuminated, conducts electricity to create a local electrical connection between the feed line 25 and resistor line 24 and thus modifying the resulting resistance $R_{res}$ between an end or terminal A of the resistor line 24 and an end or terminal B of the feed line 25. The polarization of the optical sensor 23 is to be determined based on the way the sensor stripe 20 is connected to the control electronics 21, i.e. the polarization has to be according to the direction the current flows in the circuit. For example, if the end B is connected to the positive terminal of the control electronics 21 and end A to the negative terminal, then the first end 28 of the optical sensor 23, i.e. the cathode is connected to a node 26 of the resistor line 24 and the second end 29, i.e. the anode of the photodiode is connected to a node 27 of the feed line 25. One should note however that this polarization does not play any role in the overall concept of the invention and should not limit the scope of the invention.

The light emitting device 1 is positioned on the top of the car 100 in the figures. However, the position of the light emitting device 1 can be altered according to the particular needs, with the only consequence that the control electronics 21 has to be aware where exactly the light emitting device 1 is, because the position detected is actually the position of the light emitting device 1. Usually it is desired to precisely control the bottom level of an elevator car 100 in order to ensure a flat and level transition between the floor of the car 100 and the entry floor of the building.

Figure 2A:
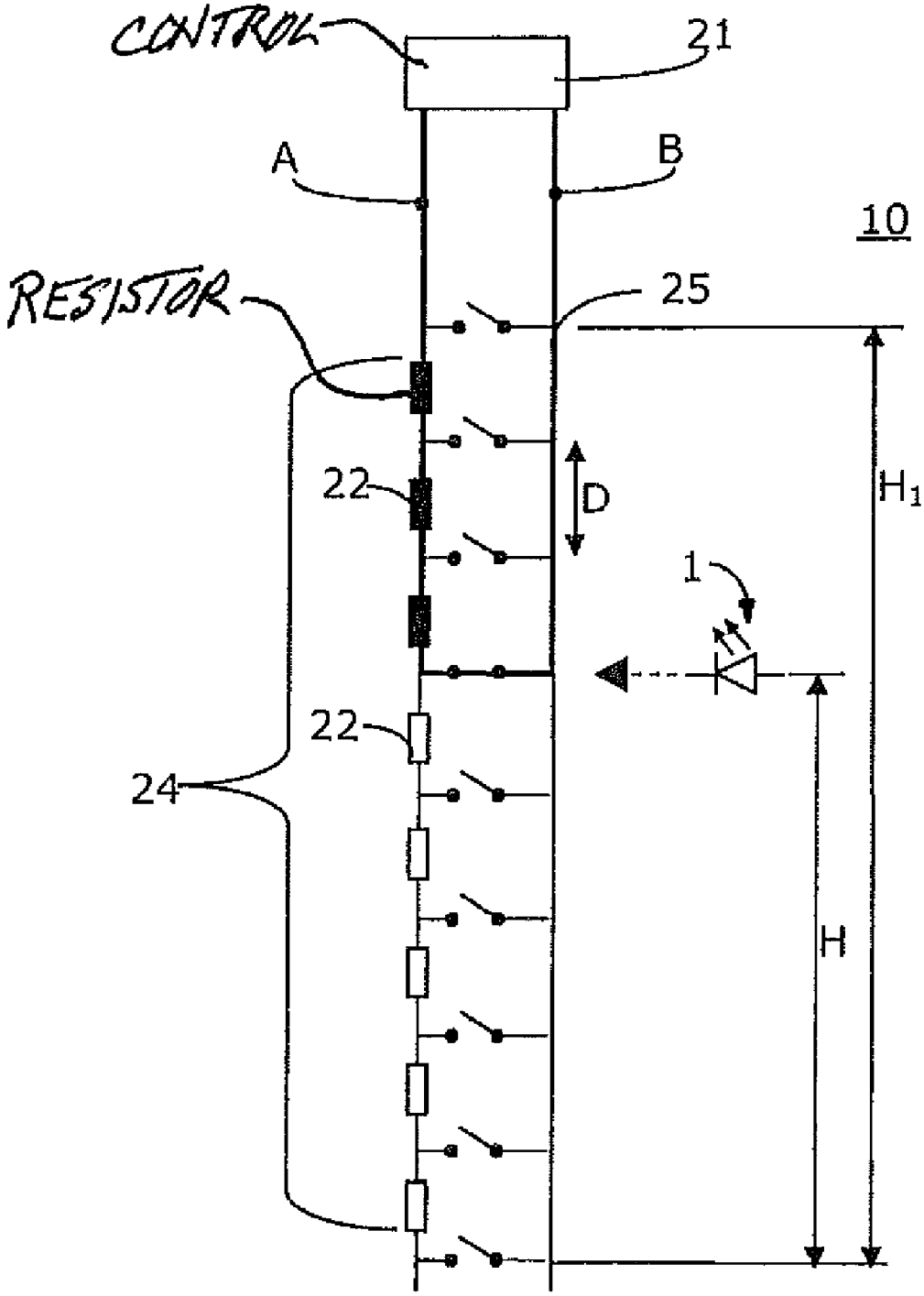
FIG. 2A is a simplified view of the preferred embodiment of the elevator car position detection system according to the present invention illustrating the resulting resistance between an end of the resistor line and an end of the feed line when one of the optical sensors of the sensor stripe is illuminated.

The operating principle of the elevator car position detection system 10 is schematically represented on FIG. 2A, where the optical sensors 23 are represented as simple on-off switches since actually that is their electrical function. In the preferred embodiment shown in FIG. 2A the resistor line 24 consists of a series of individual resistors 22 connected in series with a node of the resistor line 26 between each pair of resistors 22.

In the illustration of FIG. 2A the bold line indicates the electrical connection, i.e. the segments where current actually flows through, between the end A and the end B. The depicted situation correspond to the moment when the light emitting device 1 illuminates the fourth (from top) optical sensor 23, thus creating an electrical connection between the resistive line 24 and the feed line 25. The resulting resistance $R_{res}$ is in this case the sum of the resistance of the upper three resistors 22 and the resistance of the segments of electrical wires of the resistive line 24 and the feed line 25, the latest two being neglectable compared to the resistance of the resistors 22. This resulting resistance $R_{res}$ is used to determine which optical sensor 23 is illuminated and thus the actual position of the elevator cabin can be deducted.

In certain embodiments of the present invention, when the optical sensors 23 are equally spaced apart, and the resistors 22 have equal values, the individual optical sensor 23 illuminated can be calculated with a simple formula:

$$N=R_{res}/R$$

with N representing the $N^{th}$ optical sensor, $R_{res}$ the resulting resistance between A and B and R being the reference resistance, in the embodiment depicted on FIG. 2A the resistance of each resistor 22. Knowing N and D being the distance between each pair of optical sensor 23, the position H of the elevator relative to a reference position $H_o$ of the first optical sensor 23 can be calculated as:

$$H=H_o-N\cdot D$$

In further embodiments of the present invention, the optical sensors 23 are not equally spaced apart. This can be preferable for several reasons. One is that the precision with which the position of the car 100 has to be determined varies, i.e. in the proximity P of the stops S the required precision is higher than in other areas. In this case it is more economical to use fewer sensors in the low precision requirement zone than in the proximity P of the stops S. However, this inequality of the spacing of the optical sensor has to be taken in consideration when the position is determined. One solution is to have a so called lookup table with a pre recorded value of the resulting resistance $R_{res}$ corresponding to each possible detected position of the elevator car 100.

Figure 2B:
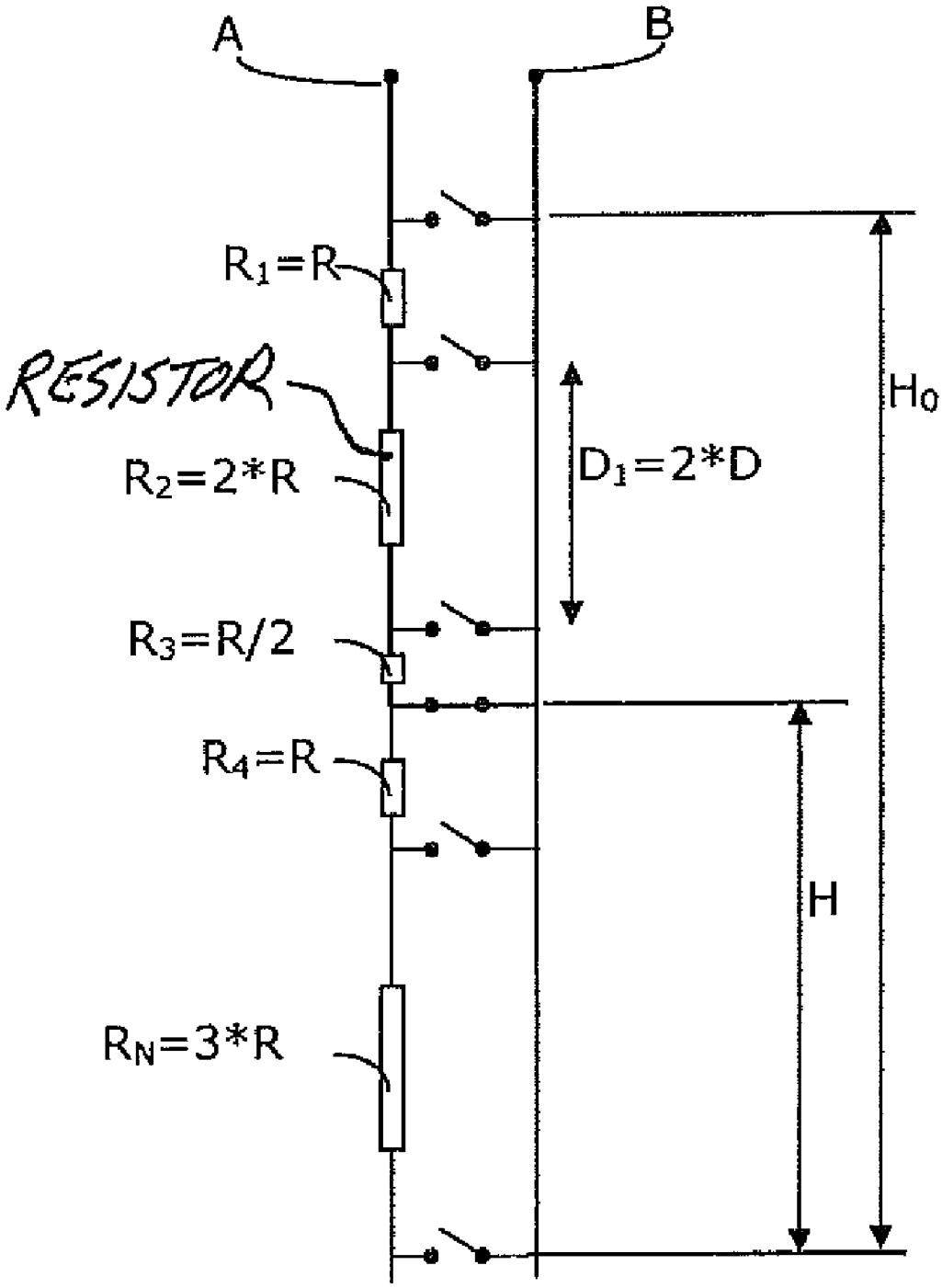
FIG. 2B is a simplified view of a further embodiment of the elevator car position detection system according to the present invention illustrating the resulting resistance between an end of the resistor line and an end of the feed line when the optical sensors are not equally spaced apart.

FIG. 2B depicts a further solution to the unequally spaced optical sensors 23, i.e. to use resistors 22 of different resistances $R_1, R_2 \ldots R_N$, each value individually calculated to be directly proportional to a distance (e.g. $D_1$) between corresponding consecutive optical sensors 23. For example if $D_1$, the distance between the second and third (from top) optical sensors 23 is twice the distance of a reference distance D, then the resistance of the resistor 22 situated between the second and third optical sensors 23 has a resistance $R_2=2*R$, where R is a reference resistance corresponding to the reference distance D. In this case the use of the simple formulas above still correctly determines the height H of the illuminated optical sensor 23. The same principle of having a resulting resistance directly proportional to the position of the optical sensors 23 can be achieved by manufacturing the entire resistor line 24 out of a single longitudinal resistor. This resistor 22 has a longitudinally uniform resistance with the first end 28 of the optical sensors 23 directly connected to this resistor 22. In this case, when an optical sensor 23 short circuits a part of the resistor 22, the resulting resistance $R_{res}$ is again proportional to the location of the particular optical sensor 23 that short circuited a part of the resistor 22 due an illumination by the light emitting device 1.

Figure 3A:
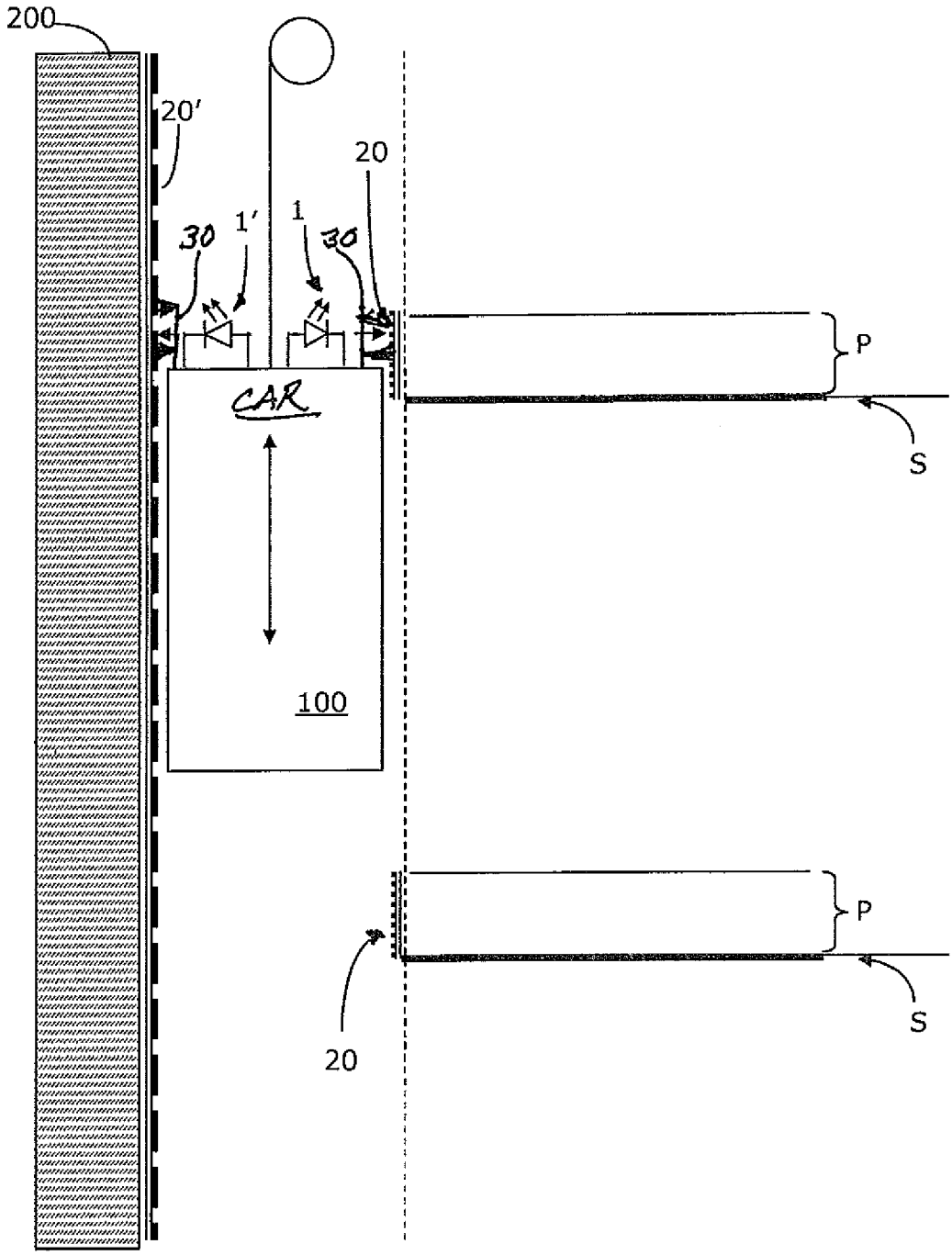
FIG. 3A is a schematic view of an elevator system with the elevator car position detection system of the present invention as installed in an elevator shaft.
Figure 3B:
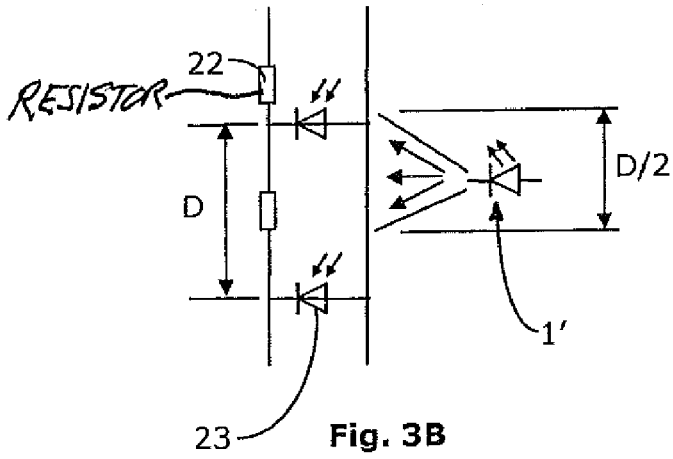
FIG. 3B is a schematic view showing a cell of an additional sensor strip of the elevator car position detection system according to a further embodiment of the present invention depicting the slightly scattered light beam of an additional light emitting device.

The requirement, that the resolution/precision of determining the position of the elevator car 100 has to be very high in the near proximity P of an elevator stop S and significantly lower in other segments of the elevator shaft, can also be satisfied by the arrangement depicted on FIG. 3A. In this arrangement, two different types of sensor stripes 20 are used. The first types of sensor stripes 20 are located in the near proximity P of each stop S of the elevator car 100 and are designed for a precise determination of the position of the elevator car 100 relative to a stop S. The second type of sensor stripe 20, the additional sensor stripe 20' is a lower resolution sensor stripe, i.e. the optical sensors 23 are placed at greater distance intervals. This means that the precision of position determination is much lower than with the first type of sensor stripes 20, but the costs are significantly lower as calculated by the length of the stripe since fewer optical sensors 23 and resistors 22 are required. This additional sensor stripe 20' is located along the entire height of the elevator shaft and is intended to be used only in combination with the first type of sensor stripes 20. This additional sensor stripe 20' is used to approximately determine the position of the elevator car 100 along the shaft, i.e. to determine in which of the stop's S proximity P the elevator car 100 is located. Once the stop S is identified and the car reaches its proximity P, the sensor stripes 20 are used to precisely determine the position of the elevator car 100. The sensor stripe 20 has in the preferred embodiment a detection resolution sufficient to enable a positioning of the elevator car's floor perfectly in line with the bottom of the building floor of the specific stop S. In the preferred embodiment of the arrangement of FIG. 3A, an additional light emitting device 1' is used to illuminate the additional sensor stripe 20'. This is preferred since the optical sensors 23 of the additional sensor stripe 20' are spaced at a larger distance apart, so to insure that at all times at least one optical sensor 23 is illuminated, the additional light emitting device 1' has to provide a slightly scattered light beam that is able to illuminate at least a portion of the sensor stripe equal to D/2, where D is the distance between two consecutive optical sensors 23 of the additional sensor stripe 20', as it is illustrated by FIG. 3B. One should note that this additional light emitting device 1' with a slightly scattered light beam is not suitable to be used in conjunction with the high precision sensor stripe 20 since it would illuminate more than one optical sensor 23 at a time. For this reason the light emitting device 1 provides a collimated narrow light beam ensuring that no more than one single optical sensor 23 of the sensor stripe 20 is illuminated at a time.

Figure 4:
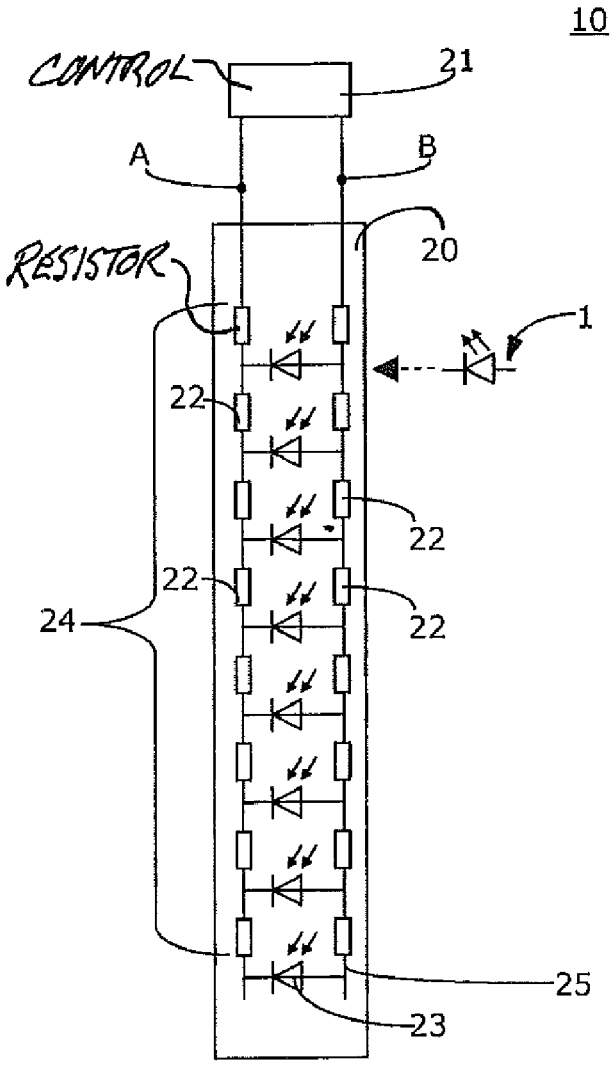
FIG. 4 is a further embodiment of the elevator car position detection system, according to the present invention.

FIG. 4 shows a further embodiment of the elevator car position detection system 10 and especially of the feed line 25 of the sensor stripe 20. In this embodiment, the feed line comprises a series of resistors 22 similar to the resistors 22 of the resistor line 24. In this case the same position determination formulas listed before are still applicable with the difference that the resulting resistance $R_{res}$ is twice as much as in the case of a feed line with neglectable resistance. For this further embodiment, the control electronics 21 has to be modified only slightly, i.e. it takes in consideration that, when illuminated, each optical sensor connects the feed line 25 and the resistor line 24 so that twice the number of resistors are passed through by the electrical current between A and B as compared to the embodiments shown in FIGS. 1A to 3B.

A further embodiment of the present invention is provided with cleaning means intended to keep the optical sensors 23 clean so that the light emitting device 1 can illuminate them. These cleaning means are brushes 30 mounted slightly above and below the light emitting device 1 and are positioned so, that when the elevator car 100 travels up and down the shaft, they swipe the surface of the optical sensors 23 to keep them dust-free. This insures a longer maintenance-free operation of the entire elevator car position detection system 10. The main requirement of these cleaning means is to be soft and smooth enough not to scratch or otherwise damage the optical sensors 23. In the preferred embodiment of these cleaning means, these brushes are removable or easily accessible to be cleaned when dust accumulates on them. One should note that this regular cleaning of these brushes requires a far smaller effort and much less time to be done, as compared to manually cleaning a sensor stripe 23 which is situated inside an elevator shaft, in certain cases all along the sidewall 200 of a very deep elevator shaft.

The sensor strip 20 may be mounted on or attached to a supporting strip. This supporting strip may be a paper like strip of a plastic strip, for instance. The sensor strip 20 together with the supporting strip may be rolled onto a drum so that when installing it, it can be unwound and attached to the wall of the shaft 200. In a preferred embodiment the supporting strip has a glue on the back side so that it can be fixed to the wall of the shaft 200.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator car position detection system, comprising:

a sensor stripe mounted on a sidewall of an elevator shaft;

an activation device mounted on an elevator car movable in the elevator shaft relative to said sensor stripe and positioned to act on a portion of said sensor stripe adjacent to the elevator car; and a control wherein said sensor stripe includes a feed line having an end connected to said control, a resistor line having an end connected to said control, and a plurality of sensors spaced along said sensor stripe and each connected between said resistor line and said feed line, wherein each of said sensors, when actuated by said actuation device, creates a local electrical connection between said feed line and said resistor line to modify a resulting resistance between said end of said resistor line and said end of said feed line representing a position of the elevator car in the elevator shaft.

2. The elevator car position detection system according to claim 1 wherein said activation device is a light emitting device mounted on the elevator car and positioned to illuminate the portion of said sensor stripe, and said sensors are optical sensors each connected between said resistor line and said feed line, wherein said optical sensors, when lit by said light emitting device, conduct electricity to create a local electrical connection between said feed line and said resistor line.

3. The elevator car position detection system according to claim 2 including cleaning means for keeping said optical sensors clean to respond to illumination from said light emitting device.

4. The elevator car position detection system according to claim 3 wherein said cleaning means includes brushes mounted on the elevator car for wiping said optical sensors.

5. The elevator car position detection system according to claim 1 wherein said control determines a position of the elevator car in the elevator shaft based on the resulting resistance between said end of said resistor line and said end of said feed line.

6. The elevator car position detection system according to claim 1 wherein said resistor line includes a plurality of individual resistors connected in series and an end of each said sensor is connected to a node of said resistor line between an associated pair of said resistors.

7. The elevator car position detection system according to claim 1 wherein said feed line includes a plurality of individual resistors connected in series and an end of each said sensor is connected to a node of said feed line between an associated pair of said resistors.

8. The elevator car position detection system according to claim 1 wherein said resistor line is a single longitudinal resistor having a resistance value higher than a resistance value of said feed line, a first end of each said sensor is connected to a node of said resistor line distributed over a length of said resistor line, and a second end of each said sensor is connected to said feed line.

9. The elevator car position detection system according to claim 1 wherein said resistor line includes a plurality of individual resistors connected in series and said sensors are not equally spaced apart, each of said resistors having a resistance value directly proportional to a vertical distance between an associated adjacent pair of said sensors.

10. The elevator car position detection system according to claim 1 wherein said control includes a lookup table storing specific values of the resulting resistance between said end of said resistor line and said end of said feed line corresponding to a plurality of positions of the elevator car in the elevator shaft.

11. The elevator car position detection system according to claim 1 including at least two of said sensor stripe mounted on the sidewall.

12. The elevator car position detection system according to claim 11 wherein said at least two sensor stripes are each located in a proximity of an associated stop of the elevator car.

13. The elevator car position detection system according to claim 1 wherein said sensor stripe is a first sensor stripe and including a plurality of second sensor stripes mounted on the sidewall, said first sensor stripe extending along an entire height of the elevator shaft and said second sensor stripes each located in a proximity of an associated stop of the elevator car, said second sensor stripes providing a precise determination of a position of the elevator car relative to the associated stop and said first sensor stripe providing an approximate indication of which of the stops the elevator car is proximate.

14. The elevator car position detection system according to claim 13 including an additional activation device for activating sensors of said second sensor stripes.

15. A method of determining a position of an elevator car in an elevator shaft comprising the steps of:

moving the elevator car in the elevator shaft along a feed line and a resistor line, both of the lines extending over substantially an entire length of the elevator shaft;

creating a local electrical connection between the feed line and the resistor line at each of a plurality of positions of the elevator in the elevator shaft;

measuring a resulting resistance value between an end of the resistor line and an end of the feed line; and determining an associated one of the positions of the elevator car based upon the measured resulting resistance.

16. An elevator car position detection system, comprising:

a sensor stripe mounted on a sidewall of an elevator shaft, said sensor stripe including a feed line having an end, a resistor line having an end and a plurality of sensors spaced along said sensor stripe and each connected between said resistor line and said feed line;

an activation device mounted on an elevator car in the elevator shaft and positioned to actuate each of said sensors when adjacent thereto; and a control connected to said end of said feed line and said end of said resistor line wherein each of said sensors, when actuated by said actuation device, creates a local electrical connection between said feed line and said resistor line to modify a resulting resistance between said end of said resistor line and said end of said feed line representing a position of the elevator car in the elevator shaft.

17. The elevator car position detection system according to claim 16 wherein said activation device is a light emitting device mounted on the elevator car and positioned to illuminate said sensors, and said sensors are optical sensors each connected between said resistor line and said feed line, wherein said optical sensors, when lit by said light emitting device, conduct electricity to create a local electrical connection between said feed line and said resistor line.

18. The elevator car position detection system according to claim 16 wherein said resistor line includes a plurality of individual resistors connected in series and an end of each said sensor is connected to a node of said resistor line between an associated pair of said resistors.

19. The elevator car position detection system according to claim 16 wherein said feed line includes a plurality of individual resistors connected in series and an end of each said sensor is connected to a node of said feed line between an associated pair of said resistors.

20. The elevator car position detection system according to claim 16 wherein said control determines a position of the elevator car in the elevator shaft based on the resulting resistance between said end of said resistor line and said end of said feed line utilizing one of calculation and a lookup table storing specific values of the resulting resistance between said end of said resistor line and said end of said feed line corresponding to a plurality of positions of the elevator car in the elevator shaft.

* * * * *